US009915479B2

(12) United States Patent
Choi

(10) Patent No.: US 9,915,479 B2
(45) Date of Patent: Mar. 13, 2018

(54) HEAT STORAGE TYPE COMBUSTION SYSTEM EQUIPPED WITH DISK TYPE DISTRIBUTOR HAVING EXCELLENT SEALING

(71) Applicants: Seung Wook Choi, Seongnam, Gyeonggi-do (KR); Kumho Environment Co., Ltd., Seongnam-si, Gyeonggi-do (KR)

(72) Inventor: Seung Wook Choi, Seongnam Gyeonggi-do (KR)

(73) Assignee: Kumho Environment Co., Ltd., Seongnam-si, Gyeonggi-do (KR)

( * ) Notice: Subject to any disclaimer, the term of this patent is extended or adjusted under 35 U.S.C. 154(b) by 0 days.

(21) Appl. No.: 15/234,752

(22) Filed: Aug. 11, 2016

(65) Prior Publication Data

US 2017/0059255 A1 Mar. 2, 2017

(30) Foreign Application Priority Data

Aug. 28, 2015 (KR) ..... 10-2015-0121396
Jul. 27, 2016 (KR) ..... 10-2016-0095136

(51) Int. Cl.
*F23L 15/02* (2006.01)
*F28D 19/04* (2006.01)

(52) U.S. Cl.
CPC ..... *F28D 19/044* (2013.01)

(58) Field of Classification Search
CPC ..... F01N 5/02; F28D 20/02; F28D 20/021; F28D 19/044; F01K 3/12
(Continued)

(56) References Cited

U.S. PATENT DOCUMENTS 5,797,738 A * 8/1998 Wills ..... F23C 6/045 431/10
2011/0132197 A1* 6/2011 Nagase ..... B01D 53/06 96/111

(Continued)

FOREIGN PATENT DOCUMENTS

KR 101011361 1/2011
KR 101029867 4/2011

*Primary Examiner* — Davis Hwu
(74) *Attorney, Agent, or Firm* — Kim Winston LLP

(57) ABSTRACT

A heat storage type combustion system equipped with a disk type distributor having improved sealing according to the present invention, the system includes: the distributor having a rotary distribution unit, a lower distribution unit located on the underside of the rotary distribution unit, an upper distribution unit located on the top of the rotary distribution unit, and a plurality of dumb buckles disposed equally spaced apart from each other along outer circumferential rims of the lower distribution unit and the upper distribution unit to fix the lower distribution unit and the upper distribution unit to each other. Each dumb buckle includes a left-handed screw and a right-handed screw formed on both end portions around the body thereof in such a manner as to be tightened or loosened repeatedly if necessary, and the number of dumb buckles is 4 to 12 in accordance with the sizes of the distributor. The state of the operating distributor is checked by naked eyes, and if the distributor is inclined or a given portion of the distributor is worn out, the distributor is returned to its normal state by means of the manipulations of the dumb buckles at the outside.

5 Claims, 7 Drawing Sheets

(58) Field of Classification Search
USPC ..... 165/8
See application file for complete search history.

(56) References Cited

U.S. PATENT DOCUMENTS

| | | | | |
|---|---|---|---|---|
| 2013/0232974 | A1* | 9/2013 | Nakhamkin | F01K 3/12 60/643 |
| 2016/0265410 | A1* | 9/2016 | Myers | F01N 5/02 |

* cited by examiner

HEAT STORAGE TYPE COMBUSTION SYSTEM EQUIPPED WITH DISK TYPE DISTRIBUTOR HAVING EXCELLENT SEALING

CROSS-REFERENCE TO RELATED APPLICATION

This application claims foreign priority to Korean Patent Application No. KR10-2016-0095136, filed Jul. 27, 2016, and Korean Patent Application No. KR10-2015-0121396, filed Aug. 28, 2015, the entire disclosures of which are incorporated by reference herein in their entirety.

FIELD OF THE INVENTION

The present invention relates to a heat storage type combustion system, which is called 'rotary regenerative thermal oxidizer RTO', and more particularly, to a heat storage type combustion system equipped with a disk type distributor having improved sealing.

BACKGROUND OF THE RELATED ART

Different kinds of harmful gases including volatile organic compounds VOCs are produced in various industrial fields, and they cause all kinds of environmental problems. Under the regulation of governments of many countries, accordingly, harmful components of the gases are forcedly removed and discharged to the air. The present invention relates to a combustion system that burns harmful and odorous gases and removes harmful components from the gases.

The combustion system is configured wherein harmful gases are introduced into a combustion chamber and they are ignited by the fuel injected from a fuel injection device disposed on one side of the combustion chamber, so that they are burnt to remove harmful components therefrom.

As one of conventional combustion systems, on the other hand, a heat storage type combustion system is provided wherein a heat storage structure is disposed in a combustion chamber so that high thermal energy of burnt gas is transmitted to the heat storage structure and the harmful gases introduced into the heat storage structure is pre-heated in the heat storage structure, thereby enhancing the combustion efficiency of the harmful gases. The conventional heat storage type combustion system includes the combustion chamber adapted to burn the harmful gases together with fuel and having the heat storage structure disposed in the interior thereof and a distributor adapted to supply the harmful gases to the interior of the combustion chamber and to discharge the burnt gases therefrom.

According to conventional technologies on the distributor, the distributor is largely classified into a drum type distributor and a disk type distributor. The disk type distributor has a large size and is made by means of casting so as to resist a high temperature generated by combustion heat, so that it has a large weight. In the process of rotating the large-sized distributor, accordingly, many problems may occur. In case of the drum type distributor, on the other hand, a drum is thermally expanded by the high temperature generated by combustion heat to cause troubles in the operation of the system, so that fire may occur.

A heat storage type combustion system having a dual disk type distributor is disclosed in Korean Patent No. 1011361 as issued to the same applicant as this invention. Besides, another heat storage type combustion system is disclosed in Korean Patent No. 1029867 as issued to the same applicant as this invention, wherein a portion of burnt gas in the combustion system as disclosed in Korean Patent No. 1011361 is collected to a combustion chamber. This invention relates to the two prior arts and is applicable to the heat storage type combustion systems of the two prior arts as well as to all kinds of heat storage type combustion systems having disk type distributors.

In case of the heat storage type combustion system having a dual disk type distributor, it is found that if the system operates for a long period of time, the distributor may be twisted or the circumferential portion of the distributor may be worn out. If so, the sealing of the distributor is not obtained fully. That is, gases leak from the interior of the distributor, thereby failing to achieve perfect purification through combustion of harmful gases.

As shown in FIG. 1, the heat storage type combustion system is configured to have a distributor 200 disposed under a combustion chamber 100 in such a manner as to supply harmful gases to the combustion chamber 100 and to discharge burnt gases to the outside. As shown in FIG. 3, the distributor 200 includes a rotary distribution unit 21 conducting a rotary motion and upper and lower distribution units 23 and 22 located on the top and underside of the rotary distribution unit 21 in such a manner as to sealingly come into contact with the rotary distribution unit 21. As shown in FIG. 5, the upper and lower distribution units 23 and 22 are fixedly located to the distributor 200 as a part of a distributor body. However, the rotary distribution unit 21, which is located between the lower distribution unit 22 and the upper distribution unit 23, rotates at a given speed. Generally, time of about 20 seconds to 2 minutes is consumed for one rotation of the rotary distribution unit 21. The rotary distribution unit 21 is supported against a shaft 50, and the shaft 50 is coupled to a gear motor 300 in such a manner as to rotate at a given speed. While the rotary distribution unit 21 is rotating, the top circumference thereof comes into contact with the underside circumference of the upper distribution unit 23 and the underside circumference thereof comes into contact with the top circumference of the lower distribution unit 22. Accordingly, grease is supplied to the circumferences coming into contact with each other to minimize the wearing on the circumferences of the respective distribution units caused by their friction. In spite of the supply of grease, the rotary distribution unit 21 is kept rotating during the operation of the combustion system, so that the top or underside circumference of the rotary distribution unit 21, the underside circumference of the upper distribution unit 23, and the top circumference of the lower distribution unit 22 are worn out by means of their friction. As a result, the rotary distribution unit 21 may be twisted, or a gap occurs due to partial abrasion of the circumference, so that gases are emitted to the outside from the interior of the distributor 200 through the gap. If the gases are emitted to the outside from the distributor 200, the operation of the combustion system stops and repairing starts. If the partial abrasion of the circumferences of the distribution units becomes serious, the combustion system is disassembled to exchange the twisted or abraded rotary distribution unit 21, lower distribution unit 22 and/or upper distribution unit 23 with new ones. It is not easy to conduct such repairing in the combustion system, and during the repairing, also, since the combustion system cannot operate, the harmful gases generated therein are not treated at a proper time. Generally, the diameter of the distributor 200 is more than 2 m, and accordingly, it is not simple to conduct the disassembling of the combustion system or the exchanging work of the distribution units.

If the partial abrasion of the rotating rotary distribution unit 21 and the partial abrasion of the lower distribution unit 22 and the upper distribution unit 23 coming into contact with the rotary distribution unit 21 are all prevented to achieve uniform abrasion, the lower distribution unit 22 or the upper distribution unit 23 coming into contact with the rotary distribution unit 21 can prevent the harmful gases from leaking to the outside of the distributor 200.

So as to solve the above-mentioned problems, the present invention suggests a new heat storage type combustion system that easily adjusts a twisted or abraded distributor having bad sealing only with a simple device. According to the present invention, while the combustion system is continuously operating, without stopping, the distributor having bad sealing can be simply adjusted.

SUMMARY OF THE INVENTION

Accordingly, the present invention has been made in view of the above-mentioned problems occurring in the prior art, and it is an object of the present invention to provide to a heat storage type combustion system equipped with a disk type distributor having improved sealing.

It is another object of the present invention to provide to a heat storage type combustion system equipped with a disk type distributor having improved sealing that can simply adjust a twisted or abraded distributor having bad sealing caused by the operation of the combustion system for a long period of time.

It is yet another object of the present invention to provide to a heat storage type combustion system equipped with a disk type distributor having improved sealing that can conduct a repairing or exchanging operation for the distributor, without stopping the operation of the combustion system.

It is still another object of the present invention to provide to a heat storage type combustion system equipped with a disk type distributor having improved sealing that can check a repairing or exchanging situation by naked eyes upon a repairing or exchanging operation, while the combustion system is continuously operating.

To accomplish the above-mentioned objects, according to the present invention, there is provided a heat storage type combustion system equipped with a disk type distributor having improved sealing, the system including: the distributor having a rotary distribution unit, a lower distribution unit located on the underside of the rotary distribution unit, an upper distribution unit located on the top of the rotary distribution unit, and a plurality of dumb buckles disposed equally spaced apart from each other along outer circumferential rims of the lower distribution unit and the upper distribution unit to fix the lower distribution unit and the upper distribution unit to each other.

According to the present invention, preferably, each dumb buckle includes a left-handed screw and a right-handed screw formed on both end portions around the body thereof in such a manner as to be tightened or loosened repeatedly if necessary, and the number of dumb buckles is 4 to 12 in accordance with the sizes of the distributor.

According to the present invention, preferably, the state of the operating distributor is checked by naked eyes, and if the distributor is inclined or a given portion of the distributor is worn out, the distributor is returned to its normal state by means of the manipulations of the dumb buckles at the outside.

According to the present invention, preferably, the plurality of dumb buckles are disposed equally spaced apart from each other along outer circumferential rims of the lower distribution unit and the upper distribution unit to fix the lower distribution unit and the upper distribution unit to each other, so that the distance between the lower distribution unit and the upper distribution unit is constantly maintained and the top and underside circumferences of the rotary distribution unit are uniformly worn out, thereby generating no gap caused by partial abrasion. As a result, the sealing of the distributor is enhanced, which prevents the gases existing in the distributor from leaking to the outside.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

The present invention relates to a heat storage type combustion system, which is called 'rotary regenerative thermal oxidizer RTO', and more particularly, to a heat storage type combustion system equipped with a disk type distributor having improved sealing.

Figure 1:
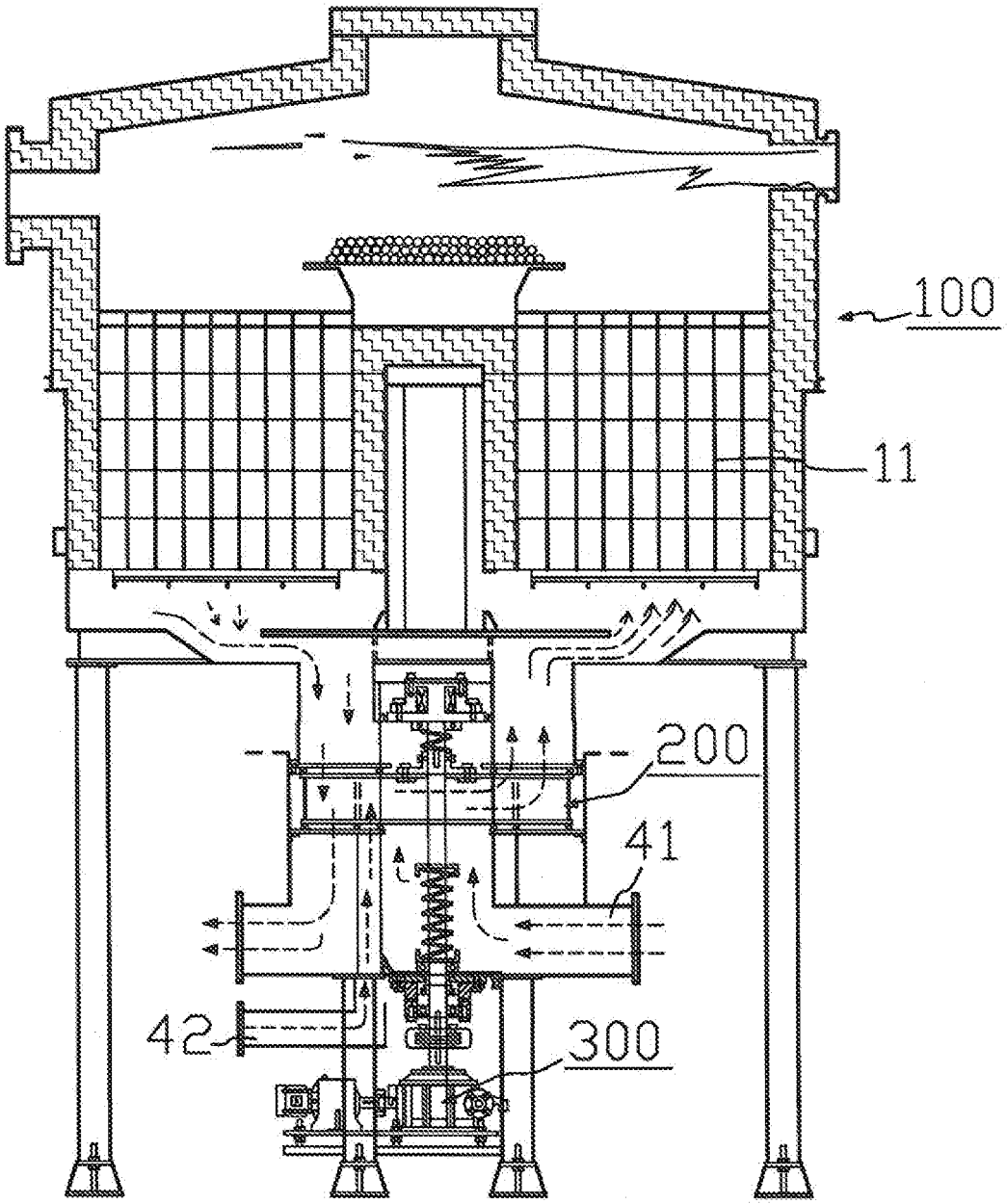
FIG. 1 is a schematic view showing a configuration of a conventional heat storage type combustion system having a disk type distributor.

FIG. 1 is a schematic view showing a configuration of a conventional heat storage type combustion system having a disk type distributor. As mentioned above, the heat storage type combustion system is disclosed in Korean Patent No. 1011361 and Korean Patent No. 1029867, and first, an explanation on the conventional heat storage type combustion system will be schematically given.

As shown in FIG. 1, the heat storage type combustion system includes the combustion chamber 100 adapted to burn harmful gases and the distributor 200 located under the combustion chamber 100 to introduce the harmful gases into the combustion chamber 100 and to discharge the harmful gases burnt in the combustion chamber 100 to the outside therefrom, and the distributor 200 includes the upper distribution unit 23 and the lower distribution unit 22 around the rotary distribution unit 21. Further, the gear motor 300 is located under the distributor 200 to supply power for rotating the rotary distribution unit 21.

Under the conventional heat storage type combustion system having the disk type distributor, the harmful gases are introduced into the system through an inlet pipe 41 and then supplied to the combustion chamber 100 via the distributor 200 by means of a blower (not shown). The harmful gases passing through a heat storage material 11 disposed in the combustion chamber 100 are distributed to the space above the heat storage material 11 and then burnt by means of a torch 12 disposed in the combustion chamber 100. The gases burnt by means of the torch 12 are discharged to an outlet pipe 43 via the heat storage material 11 and the distributor 200. A portion of gases burnt in the combustion chamber 100 is discharged directly to the outside through a discharge hole 13 formed on the upper portion of the combustion chamber 100, thereby preventing the temperature of the combustion chamber 100 from being more than an operating temperature of the system to avoid the overheating of the combustion chamber 100.

Under the conventional heat storage type combustion system having the disk type distributor, further, a purge gas is injected into the heat storage material 11 to prevent sludge or materials having explosion risks like methane formed in the heat storage material 11 from being concentrated, so that the combustion system can operate in the similar environment to that when initially installed. The purge gas is injected through a purge pipe 42 and the distributor 200 into the heat storage material 11 of the combustion chamber 100.

According to the present invention, on the other hand, a heat storage type combustion system equipped with a disk type distributor having improved sealing is configured wherein the distributor 200 includes a rotary distribution unit 21, a lower distribution unit 22 located on the underside of the rotary distribution unit 21, an upper distribution unit 23 located on the top of the rotary distribution unit 21, and a plurality of dumb buckles 70 disposed equally spaced apart from each other along outer circumferential rims 221 and 231 of the lower distribution unit 22 and the upper distribution unit 23 to fix the lower distribution unit 22 and the upper distribution unit 23 to each other.

Figure 2:
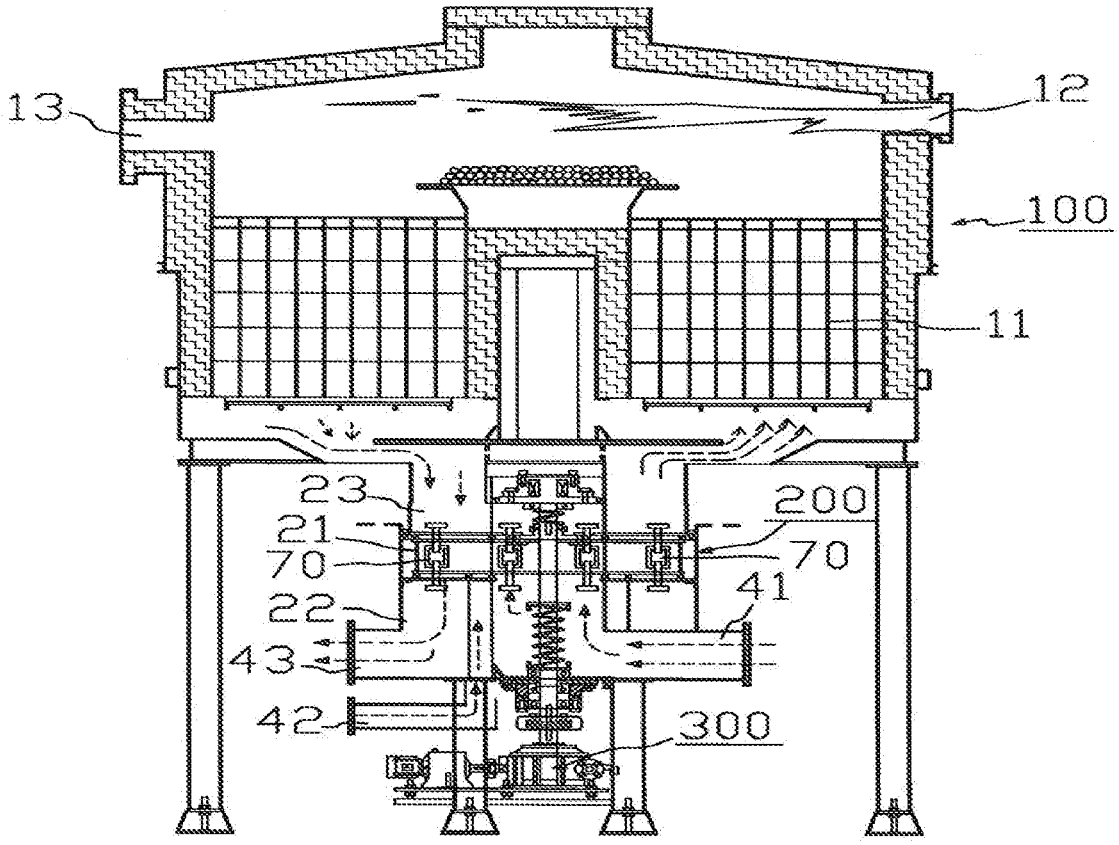
FIG. 2 is a schematic view showing a heat storage type combustion system equipped with a disk type distributor having improved sealing according to the present invention, wherein the outer circumferential rims of a lower distribution unit and an upper distribution unit of the distributor are fixed to each other by means of a plurality of dumb buckles.

FIG. 2 is a schematic view showing a heat storage type combustion system equipped with a disk type distributor having improved sealing according to the present invention, wherein the outer circumferential rims 221 and 231 of the lower distribution unit 22 and the upper distribution unit 23 of the distributor 200 are fixed to each other by means of the plurality of dumb buckles 70.

Figure 3:
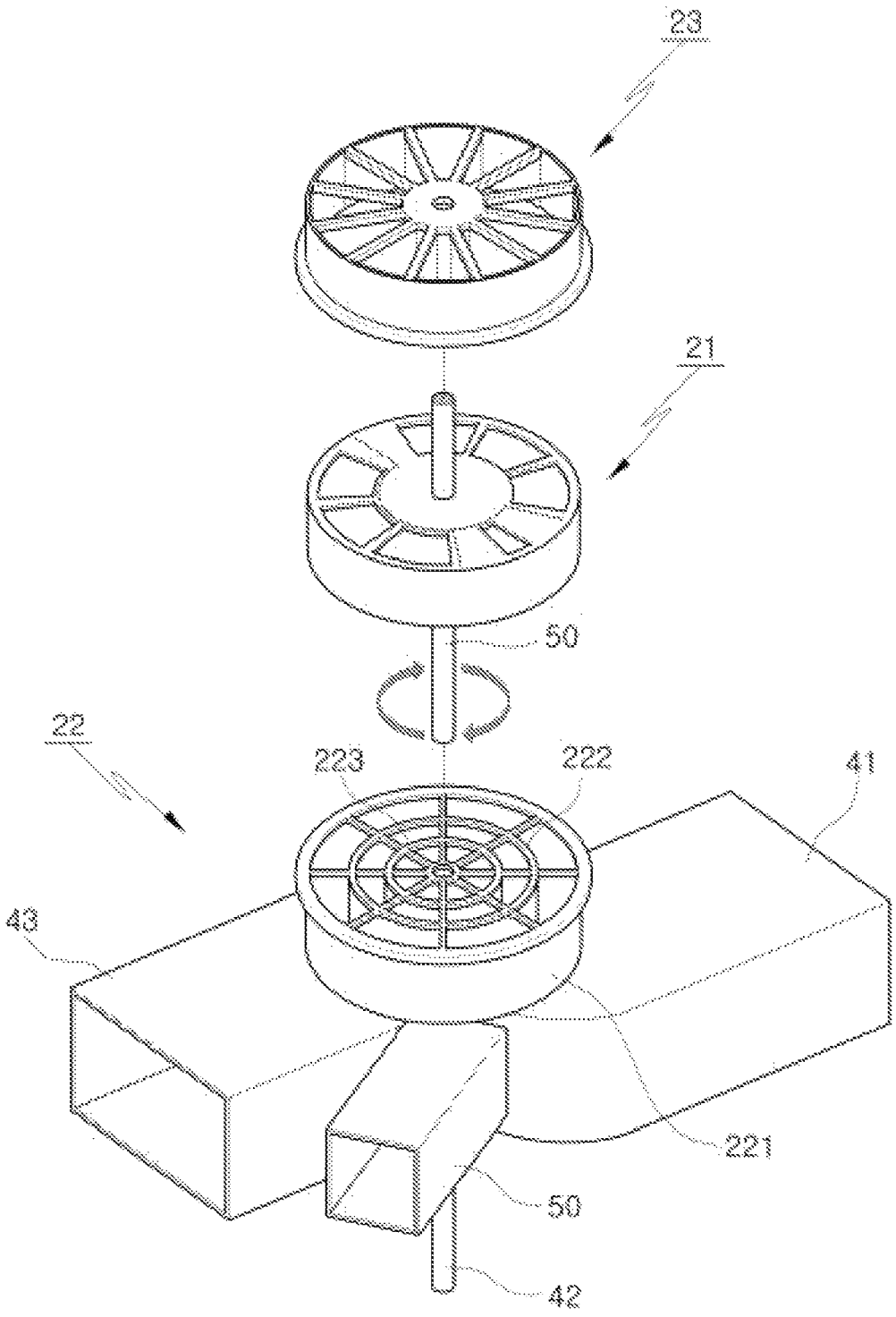
FIG. 3 is a schematic exploded perspective view showing a conventional combustion system distributor having a rotary distribution unit, a lower distribution unit, and an upper distribution unit.

The lower distribution unit 22 and the upper distribution unit 23 of the distributor 200, which are fixed to each other by means of the dumb buckles 70 adopted in the present invention, are shown in FIG. 3. FIG. 3 is a schematic exploded perspective view showing a conventional combustion system distributor having a rotary distribution unit, a lower distribution unit, and an upper distribution unit. The conventional combustion system distributor as shown in FIG. 3 is disclosed in Korean Patent No. 1011361. As shown in FIG. 3, the distributor 200 in which the dumb buckles 70 according to the present invention are adopted includes the rotary distribution unit 21, the lower distribution unit 22, and the upper distribution unit 23. The lower distribution unit 22 and the upper distribution unit 23 are fixedly located to the distributor 200 as a part of a distributor body, and the rotary distribution unit 21 rotates at a given speed. The rotary distribution unit 21 continuously comes into close contact with the upper distribution unit 23 and the lower distribution unit 22 even during the rotation thereof, thereby preventing the harmful gases from leaking to other regions.

The rotary distribution unit 21 is supported against the shaft 50, and the shaft 50 is coupled to the gear motor 300 in such a manner as to rotate at a given speed. While the rotary distribution unit 21 is rotating, the top circumference thereof comes into contact with the underside circumference of the upper distribution unit 23 and the underside circumference thereof comes into contact with the top circumference of the lower distribution unit 22. Accordingly, grease is supplied to the circumferences coming into contact with each other to minimize the wearing on the circumferences of the respective distribution units caused by their friction. In spite of the supply of grease, the rotary distribution unit 21 is kept rotating during the operation of the combustion system, so that the top or underside circumference of the rotary distribution unit 21, the underside circumference of the upper distribution unit 23, and the top circumference of the lower distribution unit 22 are worn out by means of their friction. As a result, the rotary distribution unit 21 may be twisted, or a gap occurs due to partial abrasion of the circumferences of the respective distribution units, so that gases are emitted to the outside from the interior of the distributor 200 through the gap. If the gases are emitted to the outside from the distributor 200, the operation of the combustion system stops and repairing starts. If the partial abrasion of the circumferences of the distribution units becomes serious, the combustion system is disassembled to exchange the twisted or abraded rotary distribution unit 21, the lower distribution unit 22 and/or the upper distribution unit 23 with new ones.

It is not easy to conduct such repairing in the combustion system, and during the repairing, also, since the combustion system cannot operate, the harmful gases generated therein are not treated at a proper time. Accordingly, the heat storage type combustion system according to the present invention is proposed to solve the above-mentioned problems.

Figure 4:
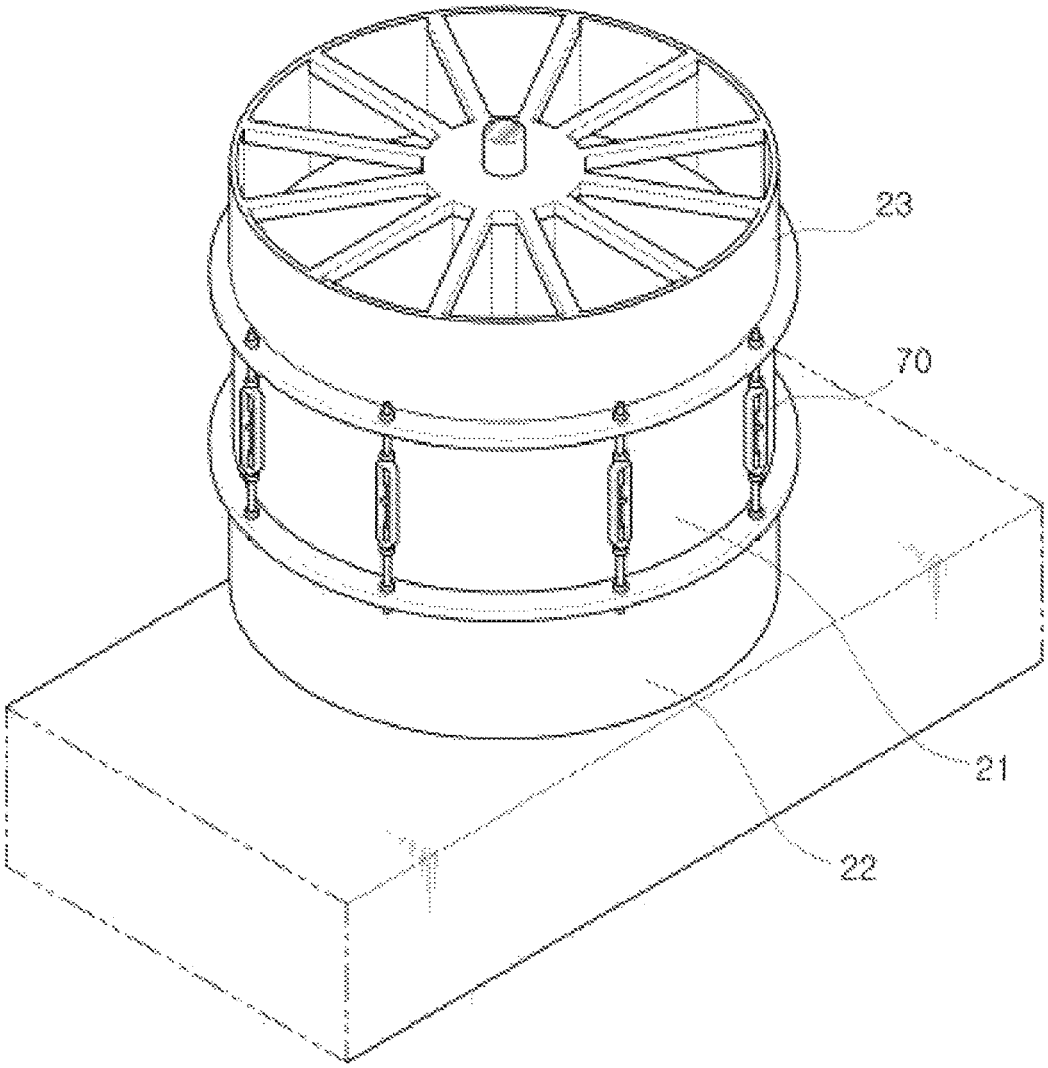
FIG. 4 is a schematic partial perspective view showing the heat storage type combustion system equipped with a disk type distributor having improved sealing according to the present invention, wherein the outer circumferences of the lower distribution unit and the upper distribution unit of the distributor are fixed to each other by means of the plurality of dumb buckles.

FIG. 4 is a schematic partial perspective view showing the heat storage type combustion system according to the present invention, wherein the outer circumferences of the lower distribution unit 22 and the upper distribution unit 23 of the distributor 200 are fixed to each other by means of the plurality of dumb buckles 70. Each dumb buckle 70 has a left-handed screw and a right-handed screw formed on both end portions around the body thereof in such a manner as to be tightened and loosened repeatedly if necessary. The dumb buckles 70 are equally spaced apart from each other along the outer circumferences of the lower distribution unit 22 and the upper distribution unit 23, and for example, the number of dumb buckles 70 is 4 to 12 in accordance with the sizes of the distributor 200. Referring to FIG. 4, the outer circumferences of the lower distribution unit 22 and the upper distribution unit 23 are fixed to each other by means of 12 dumb buckles 70. Of course, fixing of the lower distribution unit 22 and the upper distribution unit 23 to each other along the outer circumferential rims 221 and 231 by means of the dumb buckles 70 is easily carried out by the person skilled in the art.

Each dumb buckle 70 has the left-handed screw and the right-handed screw formed on both end portions around the body thereof in such a manner as to be tightened or loosened repeatedly if necessary, and accordingly, the inclined state or the abraded state of the distributor 200 is checked by naked eyes, so that the dumb buckles 70 are adjustably turned to left or right. Of course, such adjustment through the dumb buckles 70 is easily carried out by the person skilled in the art. According to the present invention, if it is checked by naked eyes that the distributor 200 has been inclined or a given portion of the distributor 200 has been worn out, the dumb buckles 70 are manipulated at the outside and adjusted to a normal state, without stopping the operation of the combustion system.

Figure 5:
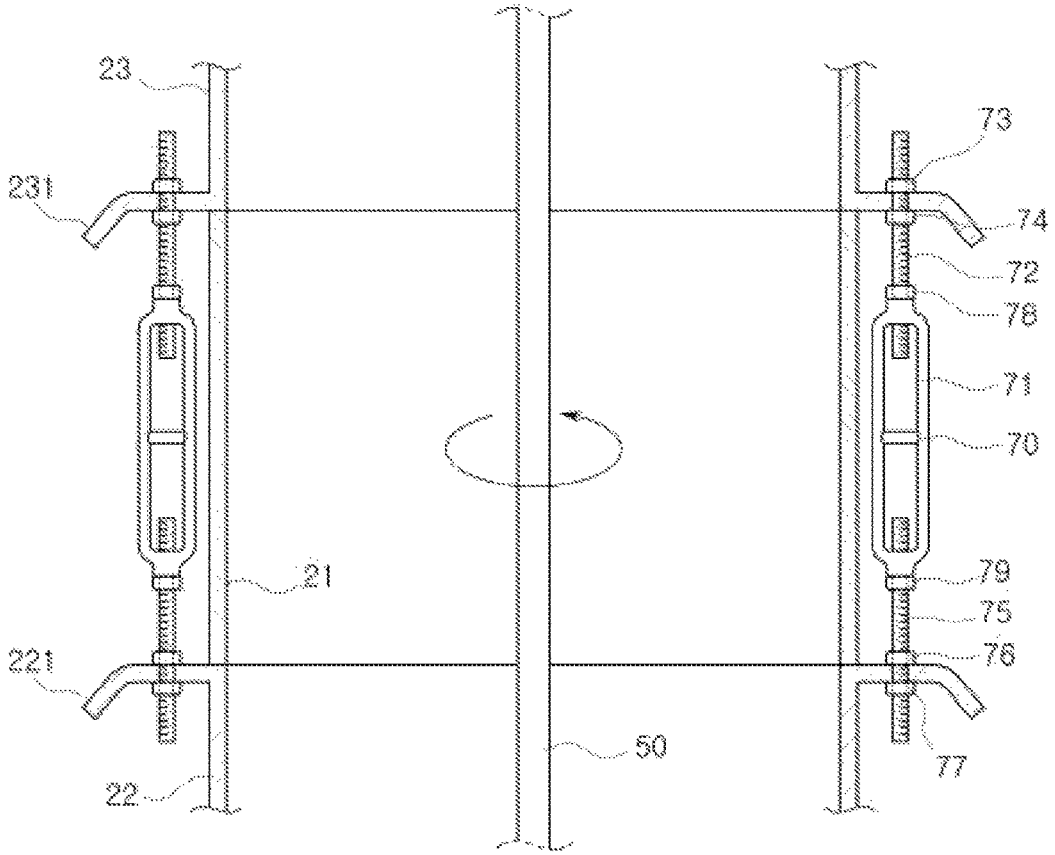
FIG. 5 is a schematic sectional view showing the heat storage type combustion system equipped with a disk type distributor having improved sealing according to the present invention, wherein the outer circumferences of the lower distribution unit and the upper distribution unit of the distributor are fixed to each other by means of the plurality of dumb buckles.
Figure 6:
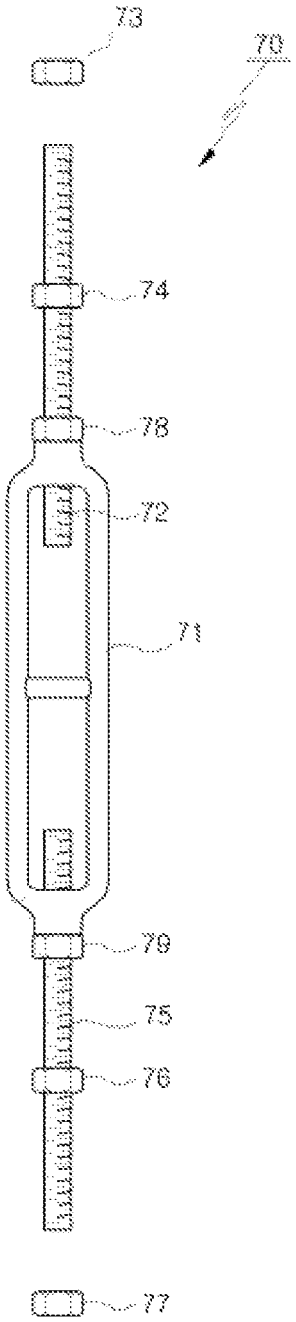
FIG. 6 is a schematic perspective view showing an example of the dumb buckle adopted in the present invention.

FIG. 5 is a schematic sectional view showing the heat storage type combustion system according to the present invention, wherein the lower distribution unit 22 and the upper distribution unit 23 of the distributor 200 are fixed to each other by means of the plurality of dumb buckles 70. FIG. 6 is a schematic perspective view showing an example of the dumb buckle of FIG. 5.

Each dumb buckle 70 includes a right-handed screw 72, a left-handed screw 75, adjusting means 71 connected to the right-handed screw 72 and the left-handed screw 75, assembly bolts 73, 74, 76 and 77, and fixing bolts 78 and 79. The assembly bolts 73 and 74 are adapted to fix the outer circumferential rim 231 of the upper distribution unit 23 thereto, and the assembly bolts 76 and 77 are adapted to fix the outer circumferential rim 221 of the lower distribution unit 22 thereto. Instead of the assembly bolts 73, 74, 76 and 77, any one of the outer circumferential rims 231 and 221 may be welded to the dumb buckles 70, and in this case, the other circumferential rim is assembled to the dumb buckles 70 by means of the assembly bolts 73 and 74 or 76 and 77. If the adjusting means 71 is turned to left and right, the length of the dumb buckle 70 is adjustable. The fixing bolts 78 and 79 serve to prevent the dumb buckle 70 from being tightened or loosened spontaneously. The dumb buckles 70 may be tightened or loosened spontaneously because the rotary distribution unit 21 is kept rotating, and so as to avoid such problems, accordingly, the heat storage type combustion system according to the present invention further has the fixing bolts 78 and 79.

Figure 7:
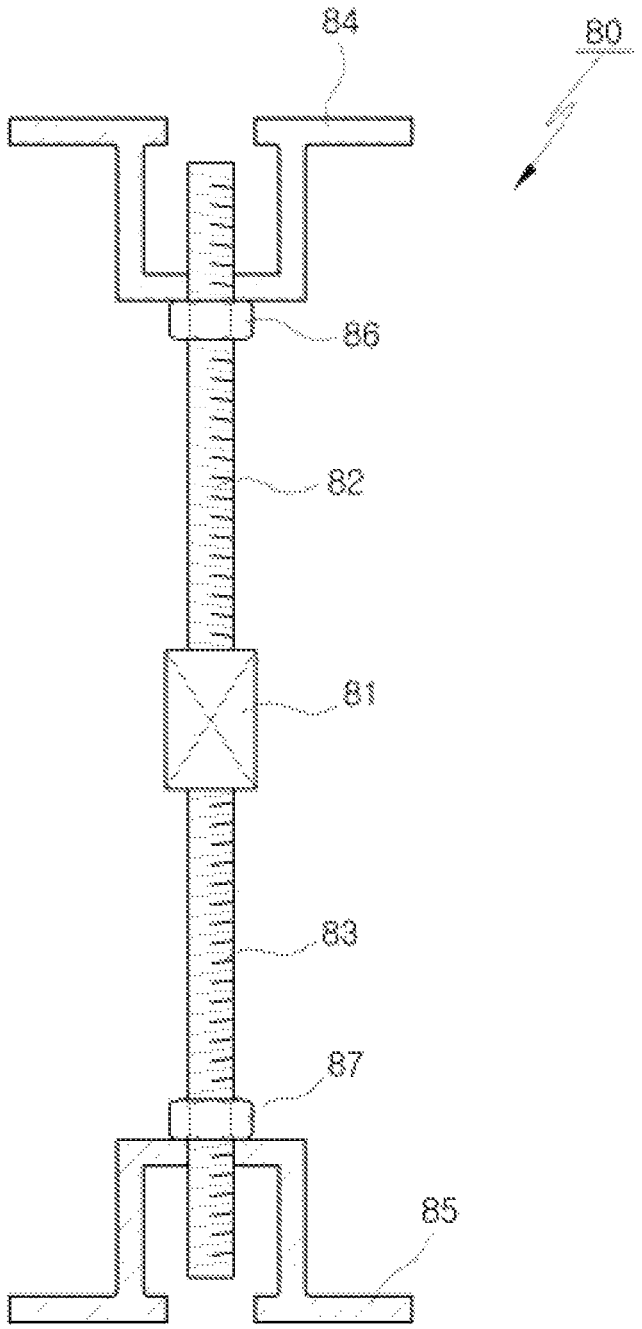
FIG. 7 is a schematic perspective view showing another example of the dumb buckle adopted in the present invention.

FIG. 7 is a schematic perspective view showing another example of the dumb buckle adopted in the present invention. As shown in FIG. 7, a dumb buckle 80 includes a right-handed screw 82 and a left-handed screw 83 formed unitarily with each other and adjusting means 81 fitted to the center of the right-handed screw 82 and the left-handed screw 83. If the adjusting means 81 is turned to left and right, the length of the dumb buckle 80 is adjustable. Further, the dumb buckle 80 includes coupling members 84 and 85 and fixing bolts 86 and 87. The coupling members 84 and 85 are assembled to the outer circumferential rims 231 and 221 through assembly bolts (not shown), and the fixing bolts 86 and 87 prevent the dumb buckle 80 from being tightened or loosened spontaneously.

As described above, the heat storage type combustion system equipped with the disk type distributor having improved sealing can simply adjust the twisted or abraded distributor having bad sealing caused by the operation of the combustion system for a long period of time, conduct repairing or exchanging operation for the distributor, without stopping the operation of the combustion system, and check a repairing or exchanging situation by naked eyes upon the repairing or exchanging operation, while the combustion system is continuously operating.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A heat storage type combustion system equipped with a disk type distributor 200 having improved sealing, the system comprising: the distributor 200 having a rotary distribution unit 21, a lower distribution unit 22 located on the underside of the rotary distribution unit 21, an upper distribution unit 23 located on the top of the rotary distribution unit 21, and a plurality of dumb buckles 70 disposed equally spaced apart from each other along outer circumferential rims 221 and 231 of the lower distribution unit 22 and the upper distribution unit 23 to fix the lower distribution unit 22 and the upper distribution unit 23 to each other.

2. The heat storage type combustion system according to claim 1, wherein each dumb buckle 70 comprises a left-handed screw and a right-handed screw formed on both end portions around the body thereof and the number of dumb buckles 70 is 4 to 12 in accordance with the sizes of the distributor 200.

3. The heat storage type combustion system according to claim 2, wherein each dumb buckle 70 further comprises fixing bolts adapted to prevent the dumb buckle 70 from being tightened or loosened spontaneously.

4. The heat storage type combustion system according to claim 3, wherein said each dumb buckle 70 further comprises assembly bolts, a first pair of assembly bolts being adapted to fix the outer circumferential rim 231 of the upper distribution unit 23 thereto and a second pair of assembly bolts being adapted to fix the outer circumferential rim 221 of the lower distribution unit 22 thereto.

5. The heat storage type combustion system according to claim 3, wherein the end portion of the right-handed screw 72 of said each dumb buckle 70 is fixedly welded to the outer circumferential rim 231 of the upper distribution unit 23 and otherwise the end portion of the left-handed screw 75 of each dumb buckle 70 is fixedly welded to the outer circumferential rim 221 of the lower distribution unit 22.

* * * * *